US011134546B2

(12) United States Patent
Schlipf

(10) Patent No.: US 11,134,546 B2
(45) Date of Patent: Sep. 28, 2021

(54) ELECTRICAL HEATING DEVICE

(71) Applicant: Türk & Hillinger GmbH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 328 days.

(21) Appl. No.: 15/926,608

(22) Filed: Mar. 20, 2018

(65) Prior Publication Data

US 2018/0279417 A1 Sep. 27, 2018

(30) Foreign Application Priority Data

Mar. 22, 2017 (DE) ..... 20 2017 101 660.9

(51) Int. Cl.

| | |
|---|---|
| ***H05B 3/40*** | (2006.01) |
| ***H05B 3/44*** | (2006.01) |
| ***H05B 3/48*** | (2006.01) |
| ***H05B 3/06*** | (2006.01) |
| *H05B 3/18* | (2006.01) |

(52) U.S. Cl.

CPC ..... *H05B 3/44* (2013.01); *H05B 3/06* (2013.01); *H05B 3/48* (2013.01); *H05B 3/18* (2013.01); *H05B 2203/016* (2013.01)

(58) Field of Classification Search

CPC ..... H05B 2203/016; H05B 3/06; H05B 3/18; H05B 3/40–48; H05B 3/68

USPC ..... 219/523, 534–544; 338/238–243

See application file for complete search history.

(56) References Cited

U.S. PATENT DOCUMENTS

| | | | | | |
|---|---|---|---|---|---|
| 2,219,523 | A | * | 10/1940 | Lampe | H01B 7/16 29/614 |
| 3,134,956 | A | * | 5/1964 | Boggs | H05B 3/06 338/273 |
| 3,839,623 | A | * | 10/1974 | Portmann | H05B 3/06 219/541 |
| 5,034,595 | A | * | 7/1991 | Grendys | H05B 3/46 219/541 |

(Continued)

FOREIGN PATENT DOCUMENTS

| | | |
|---|---|---|
| DE | 1805220 U | 2/1960 |
| DE | 102014109720 A1 | 1/2016 |

OTHER PUBLICATIONS

Search Report dated Nov. 29, 2017 in DE Application No. 202017101660.9.

*Primary Examiner* — Sang Y Paik

(74) *Attorney, Agent, or Firm* — Panitch Schwarze Belisario & Nadel LLP

(57) ABSTRACT

Electrical heating device with a tube-shaped metal sleeve, with an insulating body that is arranged in the interior of the tube-shaped metal sleeve and is passed through by at least one tunnel-like opening, with an electrical heating element, that runs with at least one section in the tunnel-like opening and with a connecting wire for the direct or indirect electrical contacting and supply of the electrical heating element that also runs with at least one section in the tunnel-like opening, wherein the sections of the electrical heating element and of the connecting wire running in the tunnel-like opening overlap each other in a contact area (K) at least in some sections, wherein the contact area (K) is in an unheated section (u) of the electrical heating device.

17 Claims, 7 Drawing Sheets

(56) References Cited

U.S. PATENT DOCUMENTS

| | | | | |
|---|---|---|---|---|
| 6,097,011 | A * | 8/2000 | Gadkaree | B01J 20/28042 219/553 |
| 6,191,400 | B1 * | 2/2001 | Cunningham | H05B 3/48 219/543 |
| 2002/0170903 | A1 * | 11/2002 | Taniguchi | F23Q 7/001 219/270 |
| 2004/0262282 | A1 * | 12/2004 | Yoshikawa | F23Q 7/001 219/270 |
| 2007/0012470 | A1 * | 1/2007 | Konnik | H02G 15/08 174/88 R |
| 2007/0278211 | A1 * | 12/2007 | Arens | D06F 58/18 219/536 |
| 2013/0056456 | A1 * | 3/2013 | Schlipf | H05B 3/44 219/546 |

* cited by examiner 190
111
120
100
A
u
110
B
190

Detail A
131
141
K
140
120
130
132
u
145

Detail B
193
192
191
190

190
190
111
110
u
100
120

210
200
220
221
A
B
u

Detail B
245b
245a
246a
246b
230
220
240
241
260
u

Detail A
241
230
240
220
241a
221
260

ELECTRICAL HEATING DEVICE

CROSS-REFERENCE TO RELATED APPLICATIONS

This application claims priority under 35 U.S.C. § 119(b) to German Application No. 20 2017 101 660.9, filed Mar. 22, 2017, the disclosure of which are incorporated herein by reference in its entirety.

BACKGROUND OF THE INVENTION

The invention relates to an electrical heating device with the features of the preamble of claim 1. This class of electrical heating devices includes, in particular, coiled tube cartridges. There is a plurality of such electrical heating devices in which an unheated area is to be provided. Here, the term "unheated area" is not to be understood in the ideal sense, because a current flow through a wire with resistance always leads, as is known, to heating, but instead in a realistic sense, i.e., as an area in which the output heating power of the electrical heating device is significantly less than the nominal heating power of the heating device per unit of length for the heated zone it is designed for. In electrical heating devices with a coiled body wound with an electrical heating element on the outside, there is no winding of the heating element in an unheated area.

In these cases, a typical procedure is not to have the actual electrical heating element, e.g., a resistive wire, traverse the entire tube-shaped metal sleeve, but instead to supply current to the resistive wire via connecting wires likewise arranged at least partially in the tube-shaped metal sleeve. A first well-known problem that occurs particularly often in low voltage applications consists in guaranteeing a simple and reliable processing of electrical contacting between the connecting wire and the electrical heating element. A second well-known problem is that the lowest possible heating of the unheated area is to be achieved with a small installation space, even in cases in which high currents must flow. This is particularly applicable because, if the heating of this unheated area is to be avoided, the materials with good electrical conductivity properties offered for use as connecting wires can for only relatively poor contacts with the typical heating conductor materials.

BRIEF SUMMARY OF THE INVENTION

The problem of the invention consists in disclosing an electrical heating device with an unheated area with improved electrical contacting and reduced heating of the unheated area even at high currents. This problem is solved by an electrical heating device with the features of claim 1. Advantageous refinements of the invention are the subject matter of the dependent claims.

The electrical heating device according to the invention has a tube-shaped metal sleeve, an insulating body that is arranged in the interior of the tube-shaped metal sleeve and is passed through by at least one tunnel-like opening, an electrical heating element that runs at least with one section in the tunnel-like opening and a connecting wire for the direct or indirect electrical contacting and supply of the electrical heating element that also runs at least with one section in the tunnel-like opening.

For the sake of correctness, it is noted that a tube-shaped metal sleeve does not have to have a circular cross section, but instead the cross section can be chosen freely.

With the term "tunnel-like opening" an opening is meant that passes through the insulating body from one end side to the other, that is, essentially in the running direction of the tube-shaped metal sleeve. One example would be a bore that passes through the insulating body in the described way; in contrast to the typical circular cross section of a hole, however, the cross section of a tunnel-like opening can be chosen freely.

It is also to be noted that a tunnel-like opening in the sense of this description can also definitely have through holes in the tunnel wall, especially toward the outside in the radial direction, so that the tunnel-like opening can have locations that are accessible from the direction of the surface of the insulating body.

It is essential according to the invention that the sections of the electrical heating element and the connecting wire running in the tunnel-like opening overlap each other in a contact area at least in some sections, wherein the contact area is in an unheated section of the electrical heating device.

The term "overlap" is understood such that the corresponding sections run approximately parallel to each other and are in contact with each other. In contrast to known contacting possibilities, in which the electrical heating element and unheated section are arranged adjacent to each other and connected with their end faces, in this way the contact surface is increased, so that contact resistances are effectively reduced and a more reliable, more reproducible, and more fail-safe contacting is achieved, especially also for material combinations that are difficult to connect to each other, in particular, high-temperature-resistant materials can be difficult to connect to each other without contaminating the insulating material, for example, MgO, which can happen during welding, e.g., for the use of fluxing agents during soldering.

The connecting wire that overlaps the section of the electrical heating element in the contact area does not have to be led completely out from the tube-shaped sleeve, but instead can be connected to another connecting wire that does this. Such an arrangement is meant when indirect electrical contacting is mentioned.

In one especially preferred embodiment of the invention, the overlapping sections of the electrical heating element and the connecting wire are connected to each other by resistive welding or ultrasonic welding. In other words, there are resistive welding locations or ultrasonic welding locations that connect the overlapping sections of the electrical heating element and the connecting wire to each other by resistive welding or ultrasonic welding. These welding processes are suitable to produce weld connections also between resistive alloys and materials with excellent electrical conductivity properties, e.g., copper or nickel. In addition, for resistive welding, weld monitoring, e.g., by a welding current measurement, can be realized by the welding of an overlapping arrangement of electrical heating element and connecting wire.

According to one especially preferred embodiment of the invention, it is provided that at least in the contact area at least one of the sections of the electrical heating element or the connecting wire is flattened on its side facing the other of the sections of the connecting wire or the electrical heating element. A flattening can be realized when a lower curvature than the curvature of a circle with a corresponding radius is present, e.g., on the less curved side of an ellipse; preferably, however, the corresponding side runs essentially flat and has no curvature in this section.

It has been shown that already by the flattening of one of the sections involved in the connection, a significant improvement of the reproducibility of the properties of the electrical contact is created and thus the process reliability is decisively improved.

It is especially preferred if the electrical heating element and/or the connecting wire are made from a flat wire material; thus, they have the geometry of a flat wire marked by a rectangular cross section. In this way, rework of the material is no longer necessary, while simultaneously an exact positioning of the conductor sections to be connected can be realized simultaneously before the production of the electrical connection, whether it is through compacting, welding, soldering, or crimping, by simply placing one on top of the other in a very simple way, which creates even more reliable processing.

At the same time, the available contact surface is significantly increased. While two overlapping conductors with circular cross section essentially form a linear contact (which already represents an improvement in comparison with point-wise contact for a connection of the end faces with each other), a surface area contact can be created that is also relatively insensitive in comparison with small positional deviations.

In particular, for a construction as a flat wire material at least in some sections, the electrical heating element and/or one or more connecting wires made from flat wire material are arranged one above the other, in order to optimize the properties of an unheated area under optimal use of the cross section of the tunnel-like opening. For example, two, three, or four connecting wires made from flat wire material can be arranged one above the other and electrically contacted to each other.

Here, connecting wires arranged, in particular, one above the other can be made from flat wire material made from the same or from different materials.

In a preferred variant of the invention, the electrical heating element is U-shaped and both legs of the U are inserted into a tunnel-like opening of the insulating body and contacted there in a contact area with a connecting wire, wherein, in each contact area, at least one of the sections of the electrical heating element or the connecting wire is flattened on its side facing the other of the sections of the connecting wire or the electrical heating element. Feeding long conductor sections through the tunnel-like openings in the insulating body is associated with a large expenditure of time that can be considerably reduced in the way described here. In addition, in this way, electrical heating devices can also be created, in which the connecting cable is led directly out from the tube-shaped sleeve, without having to create another electrical connection.

If there is, in the contact area of the tunnel-like openings, a window in the insulating body, which allows access to the tunnel-like opening, especially from the radial direction at the location of this window, a connection can also be realized by welding, soldering, or crimping at the location of this window.

In a preferred embodiment of the invention, the cross section of at least one tunnel-like opening deviates from a circular shape. For example, it could have an oval or semicircular shape. This makes it possible to optimize the cross section of the conductor, that is, of the electrical heating element and the connecting wire, which is important to be able to realize the highest possible current transport with the lowest possible heating. Such complex shaped insulating bodies can be realized, for example, as an extruded section or by means of a ceramic injection molding method.

In a preferred embodiment of the invention, two connecting wires are connected to the same section of a heating element, of which one contacts the heating element on an end face and the other overlaps the heating element at least in some sections. This is especially advantageous because the connecting wire that contacts the heating element on the end face and that has, in an especially advantageous way, the same thickness as the electrical heating element, then the second connecting wire that overlaps the electrical heating element in the contact area is positioned and stabilized, so that flat contacting of flattened surfaces is further promoted in the contact area.

It is then especially preferred, if one wants to guarantee that the lowest possible heating power is output in a given section of the electrical heating device, that there is a section in the interior of the tube-shaped metal sleeve in which the heating element and a connecting wire or two connecting wires run parallel to each other and are in electrical contact with each other, in order to form an unheated zone.

It is especially advantageous when the contact area is embedded and preferably compacted in a ceramic insulating compound or magnesium oxide.

The contact surface can be maximized and thus the influence of any local contact problems can be minimized when the contact area has a greater length than width.

The invention is especially relevant to electrical heating devices in which the heating element and the connecting wire or the connecting wires are not wound but are instead straight.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figures 1A, 1B, 1C, 1D:
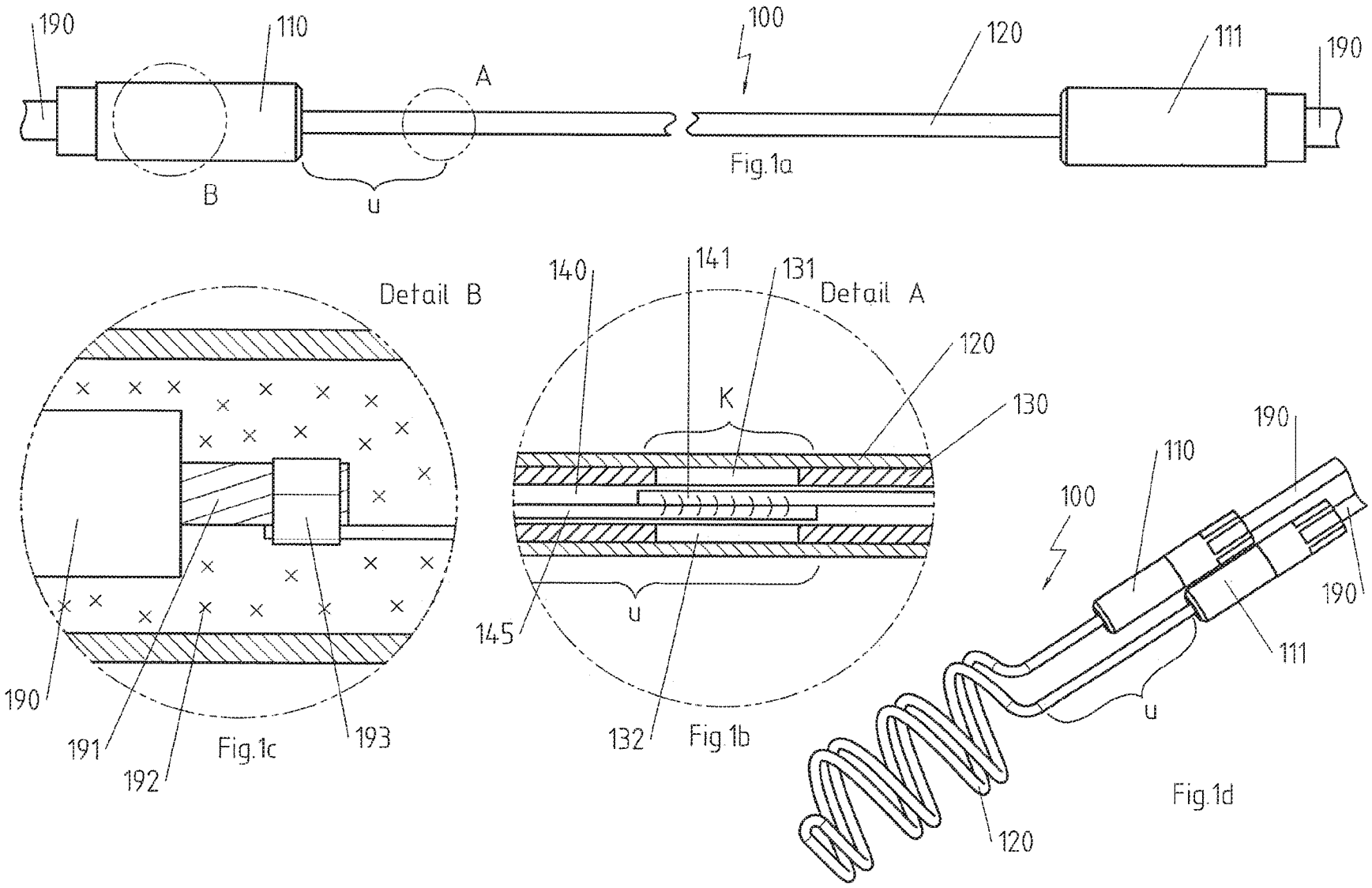
FIG. 1*a*: a first embodiment for an electrical heating device.
FIG. 1*b*: a first enlarged detail of a section in the image plane through the embodiment from FIG. 1*a*, FIG. 1*c*: a second enlarged detail of a section in the image plane through the embodiment from FIG. 1*a*, FIG. 1*d*: the electrical heating device from FIG. 1*a* in one possible use configuration.

FIG. 1*a* shows an embodiment for an electrical heating device 100 in the form of a coiled tube cartridge, which, as shown in FIG. 1*d*, can be bent and/or coiled, e.g., into a desired shape for an application and has an unheated area that is marked with u in all figures in which it is visible, and also with two-sided connections 110, 111. As can be seen especially in the section view of FIG. 1*b*, the electrical heating device 100 has a tube-shaped metal sleeve 120, in whose interior an insulating body 130 is arranged that is passed through by a tunnel-like opening 140.

Figure 1E:
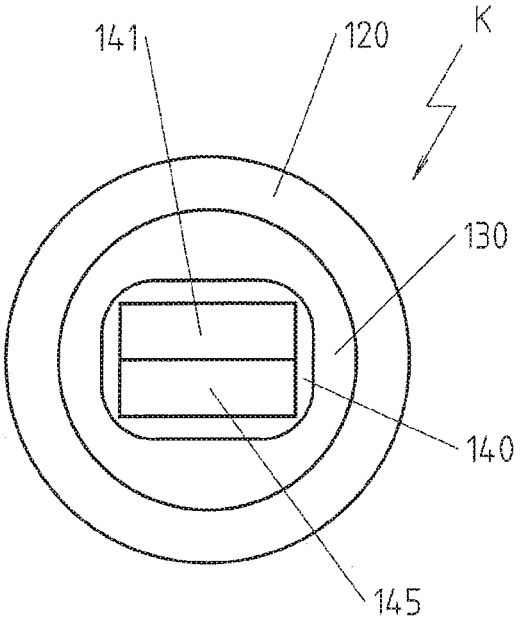
FIG. 1*e*: a cross section through a contact area of the electrical heating device from FIG. 1*a* in the direction perpendicular to its running direction.

Within the tunnel-like opening 140 there is an electrical heating element 141 that overlaps, at its end shown in FIG. 1*b* and at its other end that can be arranged, for example, at the same distance from the connection 111 as the end shown in FIG. 1*b* from the connection 110, in a contact area K with one section of a connecting wire 145 and is connected to this wire, for example, welded. Here, in the contact area K, at least one of the connected conductors, that is, the electrical heating element 141 and/or the connecting wire 145, is flattened, as can be seen particularly well in the cross-sectional view of FIG. 1*e*.

Other possible constructions of the cross sections of the electrical heating element 141 and connecting wire 145 can be seen, for example, in FIGS. 3*a* to 3*e*, where connecting wires 315, 316, 325, 326, 335, 336, 345, 346, 355, 356 and heating elements 311, 312, 321, 322, 331, 332, 341, 342, 351, 352 arranged in insulating bodies 310, 320, 330, 340, 350 each with two tunnel-like openings 317, 318, 327, 328, 337, 338, 347, 348, 357, 358 are shown.

The empty volumes remaining in the tunnel-like opening 140 can be filled with insulating material, e.g., MgO powder.

As an example, in the insulating body 130 in the contact area K, two opposing windows 131, 132 are shown. If such windows are present, it is possible to produce at least one of the electrical contacts between electrical heating element 141 and connecting wire 145 only after inserting these components from different sides into the tunnel-like opening 140, even if this is not to be a press-fit contact, bust instead should be a welded, soldered, or crimped connection.

As shown in FIG. 1*c*, a supply line 190 is led with electrical conductor 191 into the interior of the connection 110 filled with magnesium oxide 192. The electrical conductor 191 is then connected to the connecting wire 145 with a crimping element 193.

The contact area and the connection 111 are built analogously on the right side of the electrical heating device 100 shown in FIGS. 1*a* to 1*e*.

FIGS. 2*a* to 2*e* show a second embodiment of an electrical heating device 200, with tube-like metal sleeve 220 with base 221, insulating body 230 arranged in the interior of the tube-like metal sleeve 220 with these tunnel-like openings 240, 260 passing from one end side to the other end side, a U-shaped electrical heating element 241 and connecting wires 245*a*, 245*b*, 246*a*, 246*b* in which there is a connection 210 to a supply line 290 only on one side.

As can be seen especially well in the diagrams 2*d* and the variant of the diagram 2*e*, which differ only by the shape of the arc-shaped end section 241*a*, 241*b* of the electrical heating element, in this embodiment both the electrical heating element 241 and also the connecting wires 245*a*, 245*b*, 246*a*, 246*b* are each made from a flat wire material, whose cross section is constant. Here, the electrical heating element 241 is preferably made from a heating conductor material, e.g., a nickel-copper alloy, a nickel-chromium alloy, or a suitable ternary alloy, while the connecting wires 245*a*, 245*b*, 246*a*, 246*b* are preferably made from materials with good electrical conductivity properties, e.g., Cu or Ni, in order to reduce the power output in the area of the connecting wires 245*a*, 245*b*, 246*a*, 246*b*.

Figures 2A, 2B, 2C:
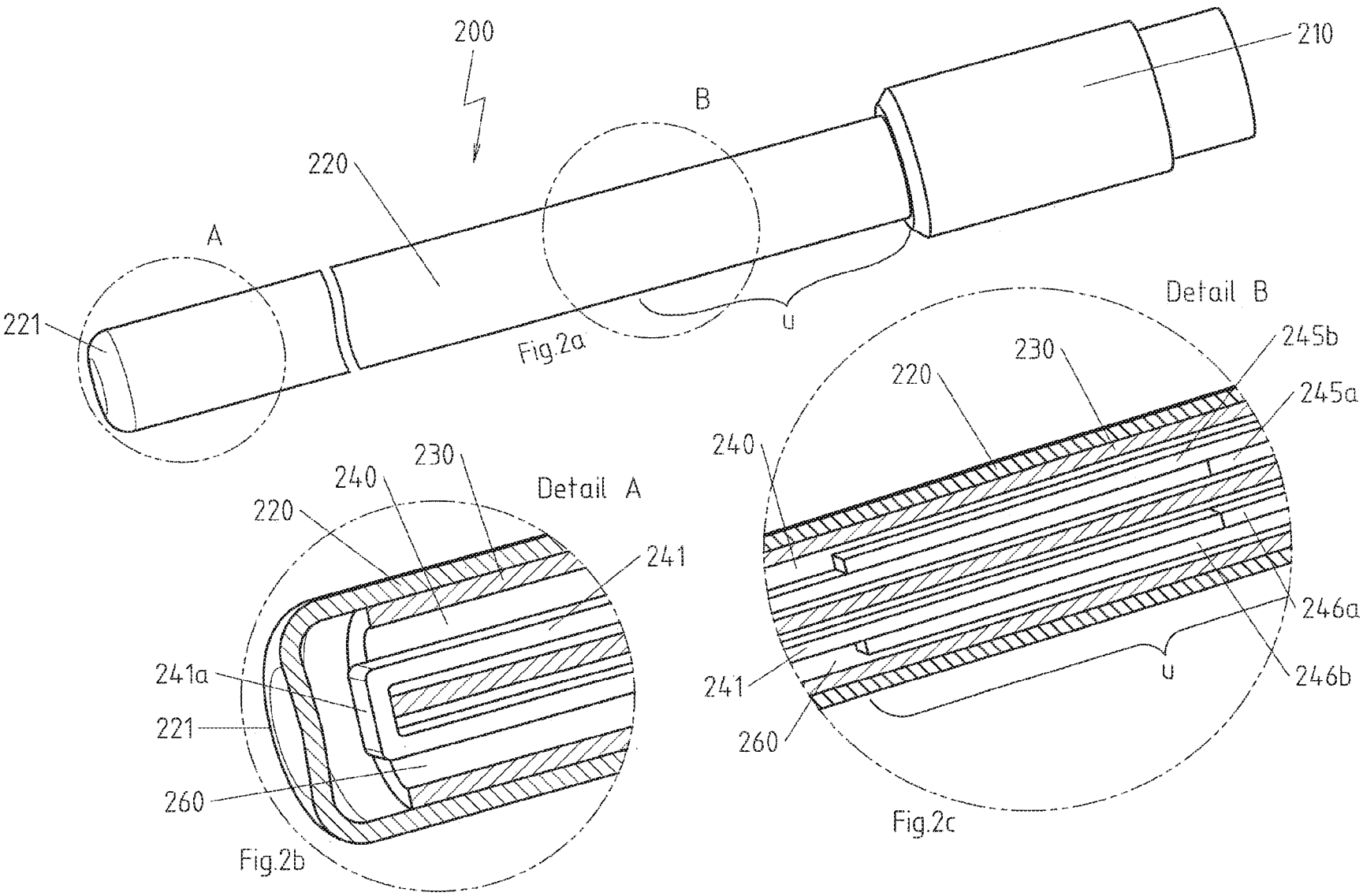
FIG. 2*a*: a second embodiment for an electrical heating device.
FIG. 2*b*: a first enlarged detail of a cross-section in the image plane through the embodiment from FIG. 2*a*, FIG. 2*c*: a second enlarged detail of a cross-section in the image plane through the embodiment from FIG. 2*a*, FIG. 2*d*: is a perspective view of the arrangement of electrical heating element and connecting wires of the electrical heating device from FIG. 2*a*, FIG. 2*e*: is a perspective view of a variant of the arrangement from FIG. 2*d*.
Figure 2D:
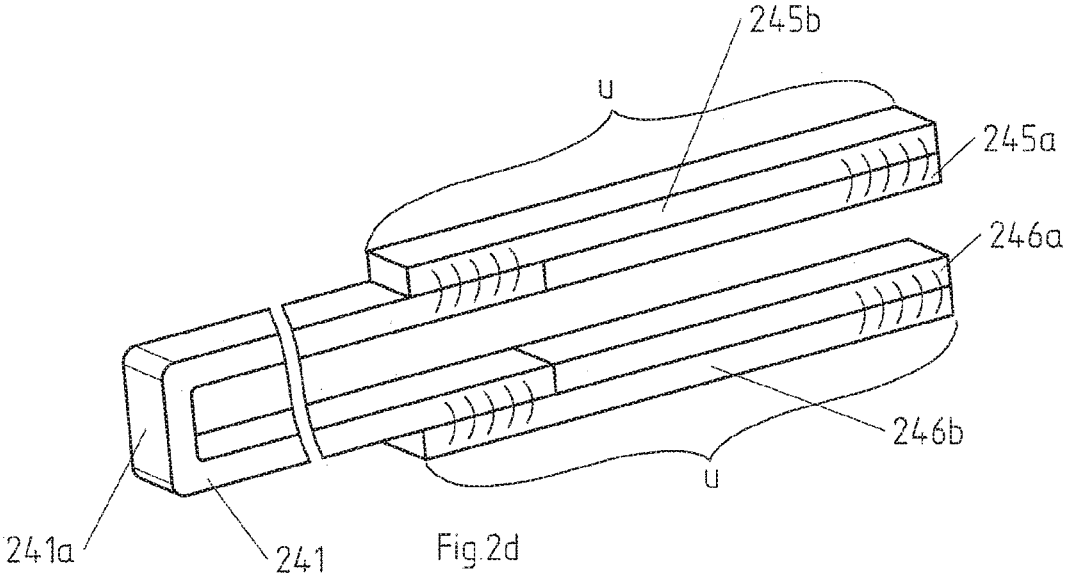
Figure 2E:
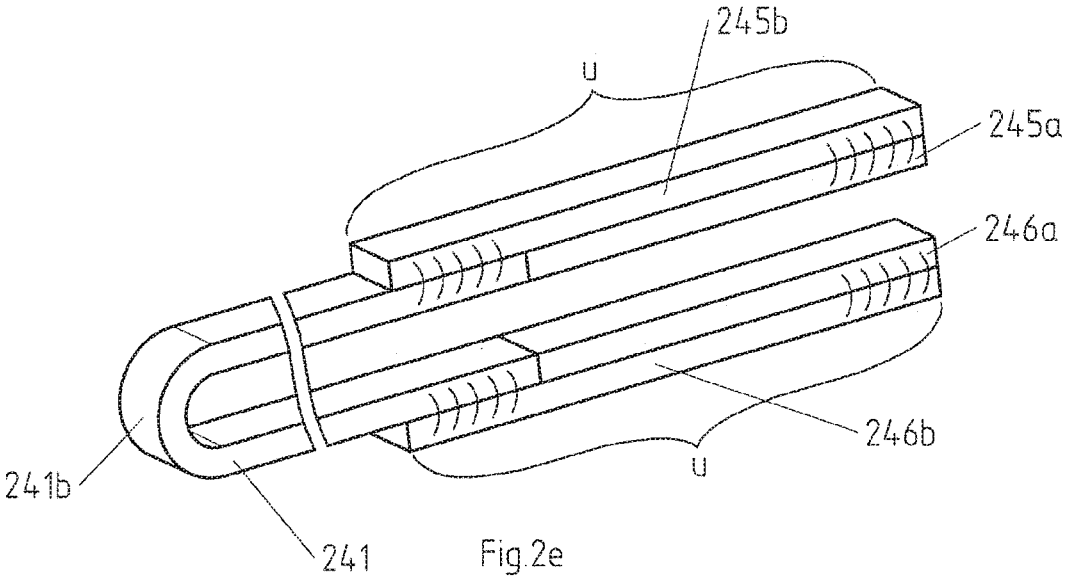

As can be seen especially well in FIGS. 2*d* and 2*e*, the two connecting wires 245*a*, 245*b* and 246*a*, 246*b* are respectively connected to an end section of the heating element 241, of which the connecting wires 245*a* and 246*a* respectively contact the heating element 241 on the end side and the other connecting wires 245*b* and 246*b* overlaps the heating element 241 in the contact area K. This arrangement makes it especially simple to produce a defined contact with good electrical conductivity properties.

It can also be seen, especially in connection with FIG. 2*c*, that in one section in the interior of the tube-like metal sleeve 220, two connecting wires 245*a*, 245*b* and 246*a*, 246*b* run parallel to each other and in electrical contact with each other, in order to form an unheated zone, in which the cross section is increased and thus the drop in heating power is low.

Figure 3A:
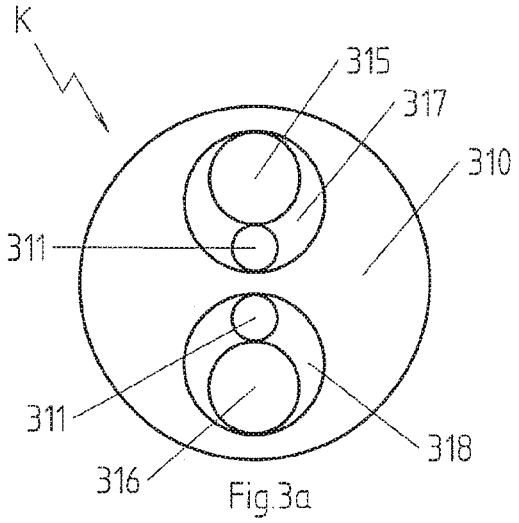
FIG. 3*a*: a cross section through a first example for an insulating body of an electrical heating device.
Figure 3C:
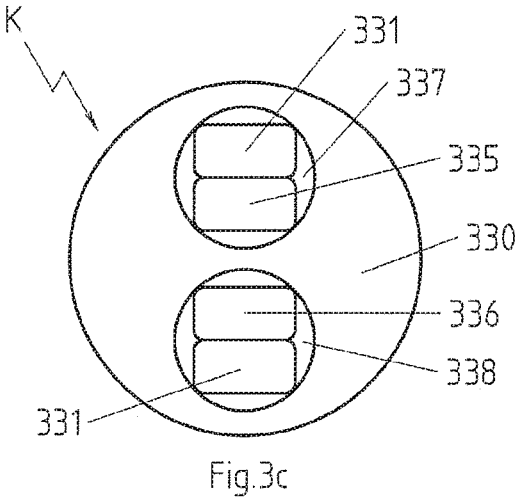
FIG. 3*c*: a cross section through a third example for an insulating body of an electrical heating device.
Figure 3B:
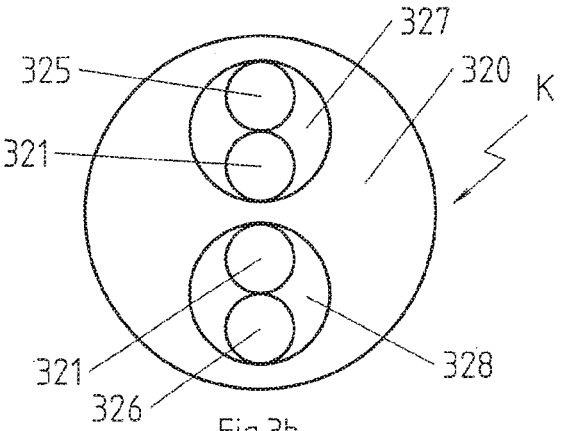
FIG. 3*b*: a cross section through a second example for an insulating body of an electrical heating device.

In FIGS. 3*a* and 3*b*, arrangements of heating elements 311, 312, 321, 322 and connecting wires 315, 316, 325, 326 overlapping the heating elements 311, 312, 321, 322 in some sections in the tunnel-like openings 317, 318, 327, 328 of insulating bodies 310, 320 are shown. While this can guarantee a good linear contact, there is still a certain problem for reliable and safe processing, which results from the fact that two round conductor sections of heating elements 311, 312, 321, 322 and connecting wires 315, 316, 325, 326 must be positioned in a circular hole and an electrical contact must be produced between them, because slippage of the relative position of the conductor sections is easily possible. In addition, the interior 313, 314, 323, 324 of the tunnel-like openings 317, 318, 327, 328 is not used optimally.

Figure 3D:
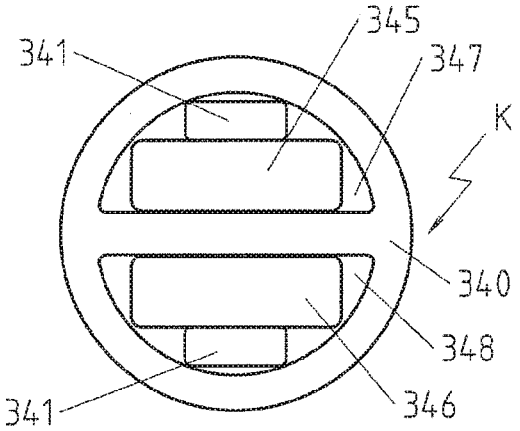
FIG. 3*d*: a cross section through a fourth example for an insulating body of an electrical heating device according to the invention.
Figure 3E:
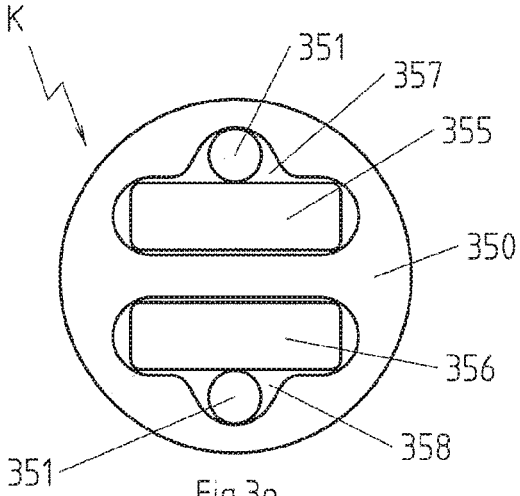
FIG. 3*e*: a cross section through a fifth example for an insulating body of an electrical heating device according to the invention.

These problems are avoided in the embodiments of FIGS. 3*c* to 3*e*, where similar connecting wires 335, 336, 345, 346, 355, 356 and heating elements 331, 332, 341, 342, 351, 352 arranged in insulating bodies 330, 340, 350 each with two tunnel-like openings 337, 338, 347, 348, 357, 358 in the cross section through a contact area K are shown.

Therefore, because in the contact area at least one of the conductors, that is, a connecting wire 335, 336, 345, 346, 355, 356 and/or a heating element 331, 332, 341, 342, 351, 352 is flattened on its side facing the conductor, with which the contact is created, that is, the heating element 331, 332, 341, 342, 351, 352 or the connecting wire 335, 336, 345, 346, 355, 356, the positioning and accordingly also the subsequent contacting is much more precise and better reproducible. In addition, by adapting the cross section of the tunnel-like openings 337, 338, 347, 348, 357, 358, on one hand, these can be better used, and, on the other hand, the insertion position can be defined exactly.

Figure 4A:
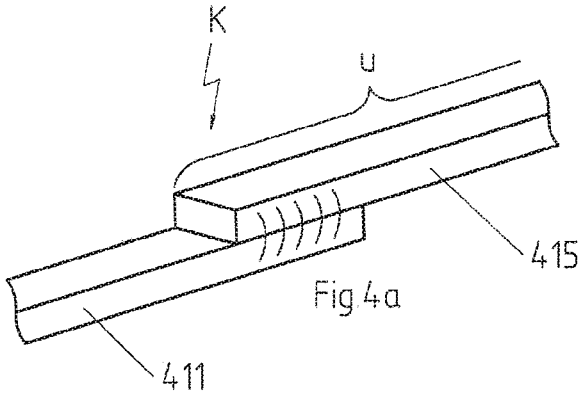
FIG. 4*a*: is a perspective view of a first example for a contact area between the electrical heating element and connecting wire.
Figure 4B:
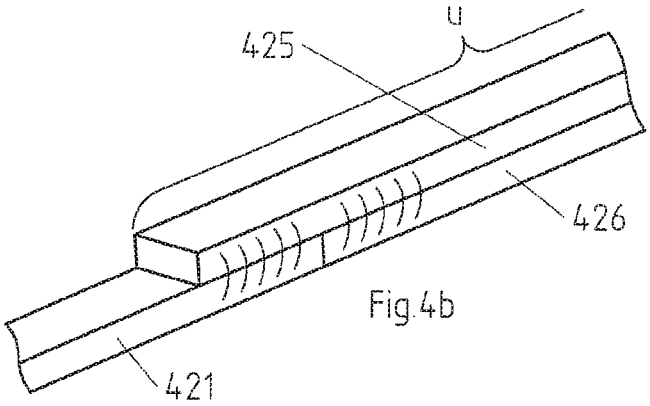
FIG. 4*b*: is a perspective view of a second example for a contact area between the electrical heating element and connecting wire.
Figure 4C:
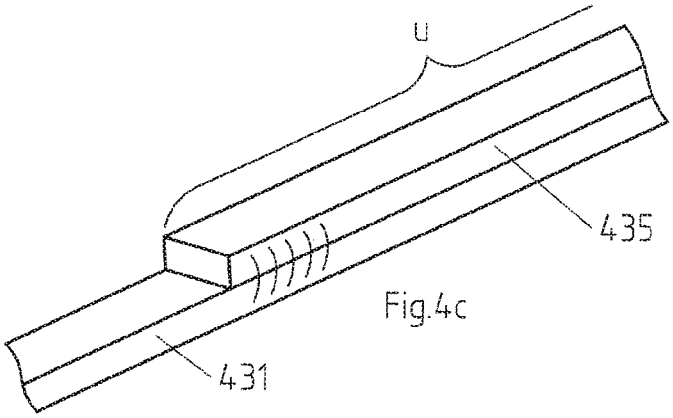
FIG. 4*c*: is a perspective view of a third example for a contact area between the electrical heating element and connecting wire.
Figure 4D:
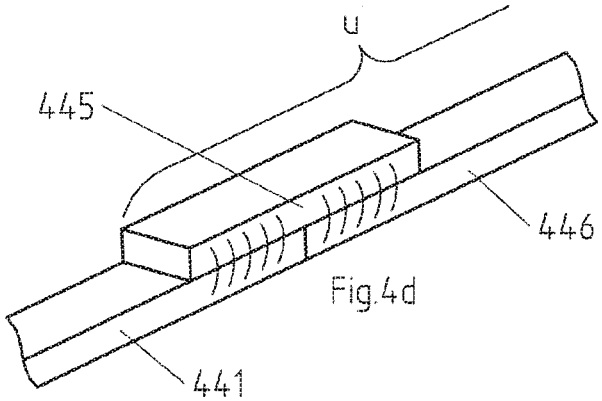
FIG. 4*d*: is a perspective view of a fourth example for a contact area between the electrical heating element and connecting wire.

As shown in FIGS. 4*a* to 4*e*, the contact area between the electrical heating elements 411, 421, 431, 441, 451 made from a heating conductor material and connecting wires 415, 425, 426, 435, 445, 446, 455, 456, 457 with good electrical conductivity properties can have different constructions. The simplest option associated with the lowest consumption of material is shown in FIG. 4*a*, in which an overlap of flattened sections of electrical heating element 411 and connecting wire 415 is easily produced. In contrast to the other embodiments of FIGS. 4*b* to 4*d*, however, here it can still occur that there is no flat contact due to tilting during insertion.

This can be avoided in that a second connecting wire 426, 446 preferably adapted with respect to its cross section to the cross section of the electrical heating element 421, 441 is used, which is brought into end-side contact with the electrical heating element 421, 441. The variant shown in FIG. 4*b* leads to unheated sections of the electrical heating device that come especially close to the ideal but is associated with higher consumption of materials than the variant of FIG. 4*d*. Another option consists in continuing the heating element 431 also in the unheated area u, but there in electrical contact with the connecting wire 435 with good electrical conductivity properties.

Figure 4E:
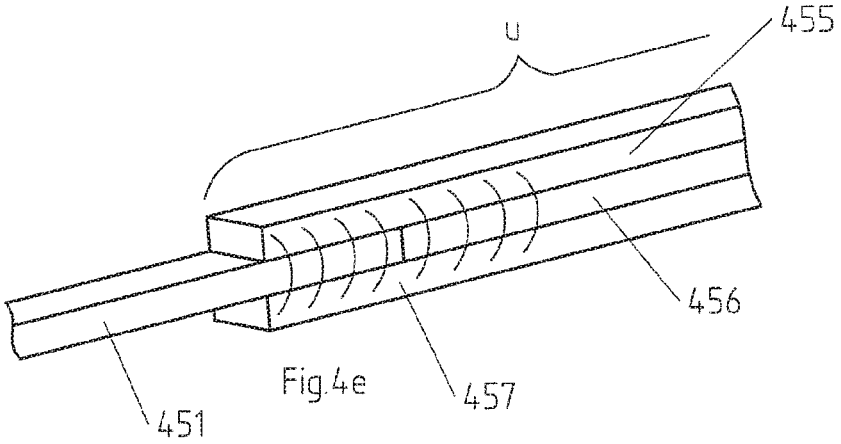
FIG. 4*e*: is a perspective view of a fifth example for a contact area between the electrical heating element and connecting wire.

If an even larger cross section is needed in the unheated area u, there is also the possibility, as shown in FIG. 4*e*, to provide, in addition to a connecting wire 456 that is adapted with respect to its cross section to the cross section of the electrical heating element 451 and that is brought into end-side contact with the electrical heating element 451 and that is selectively made from the material of the electrical heating element 451 or from a material with good electrical conductivity properties, such as, e.g., copper, also additional connecting wires 455, 457 that are arranged above and below, overlapping the electrical heating element 451 and the connecting wire 456 and made from a material with good electrical conductivity properties.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

List of reference symbols

| | |
|---|---|
| 100, 200 | Electrical heating device |
| 110, 111, 210 | Connection |
| 120, 220 | Tube-shaped metal sleeve |
| 130, 230, 310, 320, 330, 340, 350 | Insulating body |

-continued

List of reference symbols

| | |
|---|---|
| 131, 132 | Window |
| 140, 240, 260, 317, 318, 327, 328 337, 338, 347, 348, 357, 358 | Tunnel-like opening |
| 141, 241, 311, 321, 331, 341, 351, 411, 421, 431, 441, 451 | Electrical heating element |
| 145, 245a, 245b, 246a, 246b, 315, 316, 325, 326, 335, 336, 345, 346, 355, 356, 415, 425, 426, 435, 445, 446, 455, 456, 457 | Connecting wire |
| 190, 290 | Supply line |
| 191 | Electrical conductor |
| 192 | Magnesium oxide |
| 193 | Crimped element |
| 221 | Base |
| K | Contact area |
| u | Unheated area |
| A, B | Detail |

The invention claimed is:

1. An Electrical heating device with a tube-shaped metal sleeve, with an insulating body that is arranged in an interior of the tube-shaped metal sleeve and that is passed through by at least one tunnel-like opening, with an electrical heating element that runs with at least one section in the tunnel-like opening and with a connecting wire for indirect or direct electrical contacting and supply of the electrical heating element that similarly runs with at least one section in the tunnel-like opening, wherein sections of the electrical heating element and of the connecting wire running in the tunnel-like opening overlap each other in a contact area (K) at least in some sections, wherein the contact area (K) is in an unheated section (u) of the electrical heating device, wherein in the contact area (K), a window of the tunnel-like opening is provided in the insulating body, wherein the window allows access to the tunnel-like opening at a position of the window, especially from a radial direction.

2. The Electrical heating device according to claim 1, characterized in that the overlapping sections of the electrical heating element and of the connecting wire are connected to each other by resistive welding or ultrasonic welding.

3. The Electrical heating device according to claim 1, characterized in that at least one of the sections of the electrical heating element or of the connecting wire is flattened on a side facing the other of the at least one of the sections of the connecting wire or of the electrical heating element.

4. The Electrical heating device according to claim 3, characterized in that the electrical heating element and the connecting wire are made from a flat wire material.

5. The Electrical heating device according to claim 4, characterized in that, at least in some sections, the electrical heating element and the connecting wire are made from flat wire material and are arranged one above the other.

6. The Electrical heating device according to claim 5, characterized in that at least in some sections, the connecting wire includes first, second, third and fourth connecting wires made from flat wire material, the first and second connecting wires and the third and fourth connecting wires are arranged one above the other and are electrically contacted, respectively.

7. The Electrical heating device according to claim 5 characterized in that the connecting wire is comprised of connecting wires made from flat wire material arranged one above the other and are made from the same or from different materials.

8. The Electrical heating device according to claim 1, characterized in that the electrical heating element is U-shaped and legs of the U-shaped heating element are inserted into the at least one tunnel-like opening.

9. The Electrical heating device according to claim 1, characterized in that a cross section of the at least one tunnel-like opening deviates from a circular shape.

10. The Electrical heating device according to claim 1, wherein the connecting wire includes first and second connecting wires, the first and second connecting wires are connected to a first leg of the electrical heating element, the electrical heating element having a U-shape.

11. The Electrical heating device according to claim 1, characterized in that the contact area (K) is embedded or preferably compacted into a ceramic insulating compound or magnesium oxide.

12. The Electrical heating device according to claim 1, characterized in that the heating element and the connecting wire are not coiled but instead straight.

13. The Electrical heating device according to claim 1, wherein the electrical heating element includes a first leg with a first end and a first top face, the connecting wire including first and second connecting wires, the first connecting wire positioned in facing engagement with the first end and the first leg being substantially coaxial with the first connecting wire, the second connecting wire overlapping the first leg and the first connecting wire adjacent the first top face.

14. The Electrical heating device according to claim 13, wherein the first connecting wire is connected to the second connecting wire by a first weld and the second connecting wire is connected to the first leg by a second weld.

15. The Electrical heating device according to claim 13, wherein the electrical heating element has a U-shape with an arc-shaped end section and a second leg, the first and second legs spaced from the arc-shaped end section, the connecting wire including a third connecting wire and a fourth connecting wire, the third and fourth connecting wires connected to the second leg.

16. The Electrical heating device according to claim 1, wherein the electrical heating element has a U-shape with a first leg and a second leg, the connecting wire including first and second connecting wires connected to the first leg.

17. The Electrical heating device according to claim 16, wherein the connecting wire includes a third connecting wire and a fourth connecting wire, the third and fourth connecting wires connected to the second leg.

* * * * *